US012623880B2

(12) United States Patent
Tonami et al.

(10) Patent No.: US 12,623,880 B2
(45) Date of Patent: May 12, 2026

(54) MEDIUM CONVEYING APPARATUS

(71) Applicant: PFU LIMITED, Ishikawa (JP)

(72) Inventors: Norifumi Tonami, Ishikawa (JP); Sota Matsuura, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 18/975,380

(22) Filed: Dec. 10, 2024

(65) Prior Publication Data

US 2025/0100839 A1 Mar. 27, 2025

Related U.S. Application Data

(63) Continuation of application No. PCT/JP2022/024504, filed on Jun. 20, 2022.

(51) Int. Cl.
*B65H 31/02* (2006.01)

(52) U.S. Cl.
CPC ..... *B65H 31/02* (2013.01); *B65H 2402/31* (2013.01); *B65H 2403/41* (2013.01); *B65H 2405/11164* (2013.01); *B65H 2405/33125* (2013.01); *B65H 2405/354* (2013.01); *B65H 2801/39* (2013.01)

(58) Field of Classification Search
CPC ..... B65H 2402/31; B65H 31/20; B65H 2403/41; B65H 2405/33115; B65H 2405/351; B65H 2405/354; B65H 2407/21; B65H 31/02; B65H 2405/11164; B65H 2405/1117; G03G 15/6514; B56H 2405/33125
See application file for complete search history.

(56) References Cited

U.S. PATENT DOCUMENTS

| | | | | |
|---|---|---|---|---|
| 7,395,991 | B2 * | 7/2008 | Kuo | B65H 31/00 248/292.12 |
| 10,348,918 | B2 | 7/2019 | Hongo et al. | |
| 10,913,629 | B2 * | 2/2021 | Yoshita | H04N 1/00519 |
| 11,724,904 | B2 * | 8/2023 | Hamada | B65H 5/062 271/3.14 |

FOREIGN PATENT DOCUMENTS

| | | | |
|---|---|---|---|
| JP | 07-133050 | A | 5/1995 |
| JP | 2020-007093 | A | 1/2020 |
| WO | 2017/187488 | A1 | 11/2017 |

OTHER PUBLICATIONS

International Search Report issued in corresponding International Patent Application No. PCT/JP2022/024504, dated Aug. 16, 2022, with English translation.

* cited by examiner

*Primary Examiner* — Jeremy R Severson
(74) *Attorney, Agent, or Firm* — Rimon P.C.

(57) ABSTRACT

A medium conveying apparatus includes an apparatus body in which a conveying path is formed, a media tray supported by the apparatus body, an ejection tray supported by the apparatus body, a conveyor to convey a medium placed on the media tray along the conveying path and place the medium on the ejection tray, a first mechanism including a gear, and a second mechanism including a gear. The first mechanism swings the ejection tray from a deployed position where the ejection tray is deployed to a stored position where the ejection tray is stored in the apparatus body, and stops swinging of the ejection tray at a midway position between the deployed position and the stored position. The second mechanism retracts the ejection tray when the swinging of the ejection tray is stopped.

7 Claims, 14 Drawing Sheets

MEDIUM CONVEYING APPARATUS

CROSS-REFERENCE TO RELATED APPLICATIONS

This patent application is a continuation application of International Application No. PCT/JP2022/024504, filed on Jun. 20, 2022, in the Japan Patent Office, the entire disclosure of which is hereby incorporated by reference herein.

BACKGROUND

The present disclosure relates to a medium conveying apparatus.

Medium conveying apparatuses including an ejection tray that is automatically extended and retracted are known. In such a medium conveying apparatus, relatively large media can be appropriately placed on the ejection tray when the ejection tray is extended. Further, the ejection tray can be stored in the apparatus body even when the apparatus body is relatively small by retracting the ejection tray. In such cases, the medium conveying apparatus can be stored in a small space.

SUMMARY

The medium conveying apparatus according to one aspect of the present disclosure includes an apparatus body in which a conveying path is formed, a media tray supported by the apparatus body, an ejection tray supported by the apparatus body, a conveyor to convey a medium placed on the media tray along the conveying path and place the medium on the ejection tray, a first mechanism including a gear, and a second mechanism including a gear. The first mechanism swings the ejection tray from a deployed position where the ejection tray is deployed to a stored position where the ejection tray is stored in the apparatus body, and stops swinging of the ejection tray at a midway position between the deployed position and the stored position. The second mechanism retracts the ejection tray when the swinging of the ejection tray is stopped.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
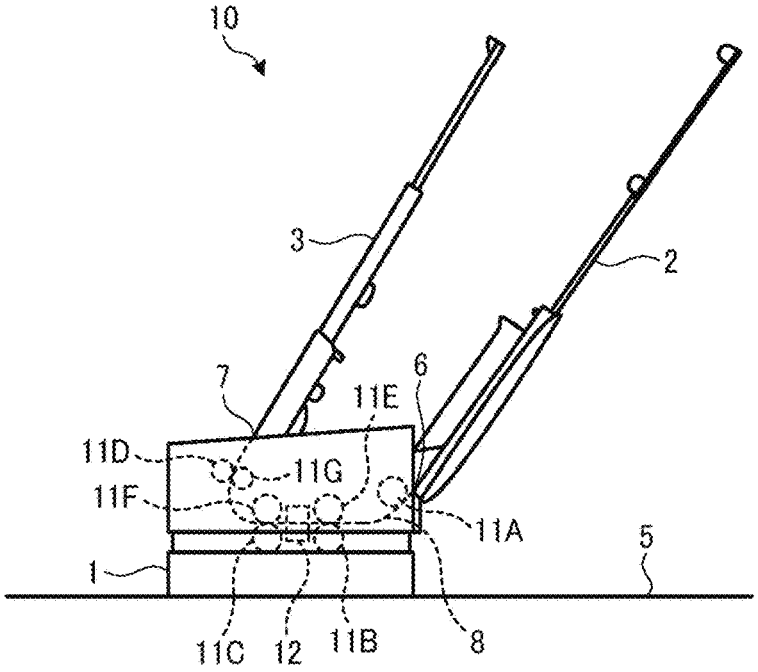
FIG. 1 is a side view of an image reading apparatus including a medium conveying apparatus according to a first embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, medium conveying apparatuses according to some embodiments of the present disclosure are described below with reference to the drawings. The technologies according to the present disclosure are not limited to those in the following description. In the following description, like reference signs denote like elements, and redundant descriptions thereof are simplified or omitted. As used herein, the singular forms "a," "an," and "the" are intended to include the plural forms as well, unless the context clearly indicates otherwise.

First Embodiment

A medium conveying apparatus according to a first embodiment is included in an image reading apparatus 10 as illustrated in FIG. 1. FIG. 1 is a side view of an image reading apparatus 10 including a medium conveying apparatus according to a first embodiment. The image reading apparatus 10 includes a medium conveying apparatus body 1, a media tray 2, and an ejection tray 3. The medium conveying apparatus body 1 is roughly box shaped. In the medium conveying apparatus body 1, a feed opening 6, an ejection opening 7, and a conveying path 8 are formed. The ejection opening 7 is connected to the feed opening 6 via the conveying path 8.

The image reading apparatus 10 further includes a conveyor 11 and an image reader 12. The conveyor 11 is located inside the medium conveying apparatus body 1. The conveyor 11 includes the conveying path 8, a pick roller 11A, a first feed roller 11B, a second feed roller 11C, a third feed roller 11D, a first pressure roller 11E, a second pressure roller 11F, and a third pressure roller 11G. The conveyor 11 feeds one of multiple media inserted into the feed opening 6 to the conveying path 8. The conveyor 11 further conveys the medium along the conveying path 8 toward the ejection opening 7 and ejects the medium from the ejection opening 7 to the outside of the medium conveying apparatus body 1. The image reader 12 is located inside the medium conveying apparatus body 1. The image reader 12 captures an image of the medium conveyed along the conveying path 8.

Figure 2:
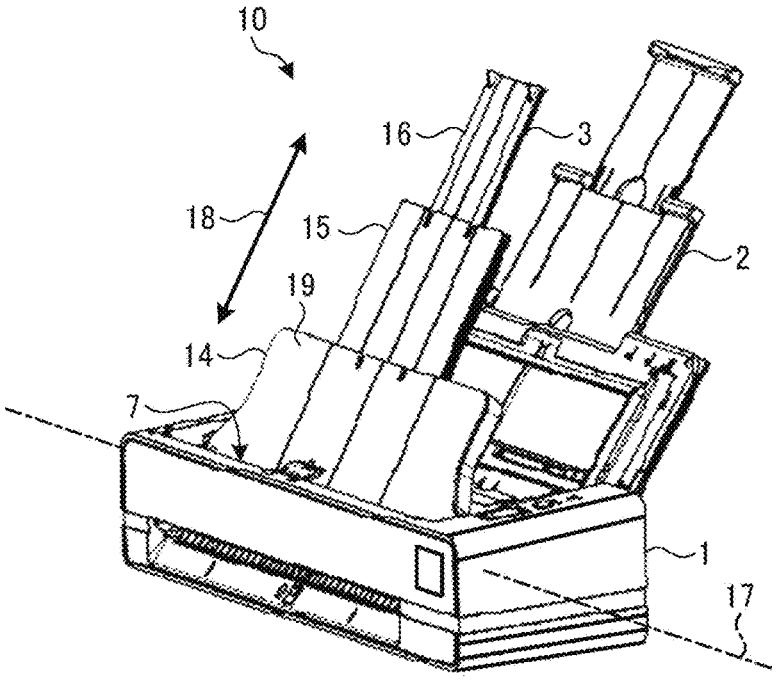
FIG. 2 is a perspective view of the image reading apparatus according to the first embodiment when a media tray is properly deployed and an ejection tray is properly deployed.

As illustrated in FIG. 2, the ejection tray 3 includes an ejection tray body 14, a first ejection-tray extension 15, and a second ejection-tray extension 16. FIG. 2 is a perspective view of the image reading apparatus 10 when both of the media tray 2 and the ejection tray 3 are properly deployed. The ejection tray body 14 is plate shaped. The ejection tray body 14 is supported by the medium conveying apparatus body 1 swingably about a swing axis 17. The swing axis 17 is parallel to both of a plane along which an installation surface 5 of the image reading apparatus 10 lies and a plane along which the ejection tray body 14 lies. The ejection tray body 14 swings about the swing axis 17 and is positioned at an ejection-tray deployed position, an ejection-tray stored position, or a midway position therebetween.

The first ejection-tray extension 15 is plate shaped. The first ejection-tray extension 15 is located along the plane along which the ejection tray body 14 lies. The first ejection-tray extension 15 is supported by the ejection tray body 14 to be translated in an ejection-tray extension-retraction direction 18. The ejection-tray extension-retraction direction 18 is perpendicular to the swing axis 17 and parallel to the plane along which the ejection tray body 14 lies. The first ejection-tray extension 15 can be translated in the ejection-tray extension-retraction direction 18 and is positioned at a first ejection-tray retracted position, a first ejection-tray extended position, or a first extension-tray extension midway position.

The second ejection-tray extension 16 is plate shaped. The second ejection-tray extension 16 is located along the plane along which the ejection tray body 14 lies. The second ejection-tray extension 16 is supported by the first ejection-tray extension 15 to be translated in the ejection-tray extension-retraction direction 18. The second ejection-tray extension 16 can be translated in the ejection-tray extension-retraction direction 18 and is positioned at a second ejection-tray retracted position or a second ejection-tray extended position.

The ejection tray 3 includes an ejection-tray placement surface 19. The ejection-tray placement surface 19 is formed by a surface of the ejection tray body 14, a surface of the first ejection-tray extension 15, and a surface of the second ejection-tray extension 16. The ejection-tray placement surface 19 is substantially flat and along the plane along which the ejection tray body 14 lies.

The ejection tray 3 is properly extended when the first ejection-tray extension 15 is positioned at the first ejection-tray extended position and the second ejection-tray extension 16 is positioned at the second ejection-tray extended position. When the ejection tray 3 is properly extended, the length of the ejection tray 3 in the ejection-tray extension-retraction direction 18 is maximized and the area of the ejection-tray placement surface 19 is maximized. The ejection tray 3 is properly deployed when the ejection tray 3 is properly extended and the ejection tray body 14 is positioned at the ejection-tray deployed position. When the ejection tray 3 is properly deployed, the ejection-tray placement surface 19 is connected to the ejection opening 7. When the ejection tray body 14 is located at the ejection-tray deployed position, the ejection-tray placement surface 19 of the ejection tray 3 faces obliquely upward.

When the second ejection-tray extension 16 is positioned at the second ejection-tray retracted position, the second ejection-tray extension 16 is positioned inside the first ejection-tray extension 15. When the first ejection-tray extension 15 is positioned at the first ejection-tray retracted position, the first ejection-tray extension 15 is positioned inside the ejection tray body 14. The ejection tray 3 is properly retracted when the second ejection-tray extension 16 is positioned at the second ejection-tray retracted position and the first ejection-tray extension 15 is positioned at the first ejection-tray retracted position. When the ejection tray 3 is properly retracted, the ejection-tray placement surface 19 of the ejection tray 3 is minimized.

Figure 3:
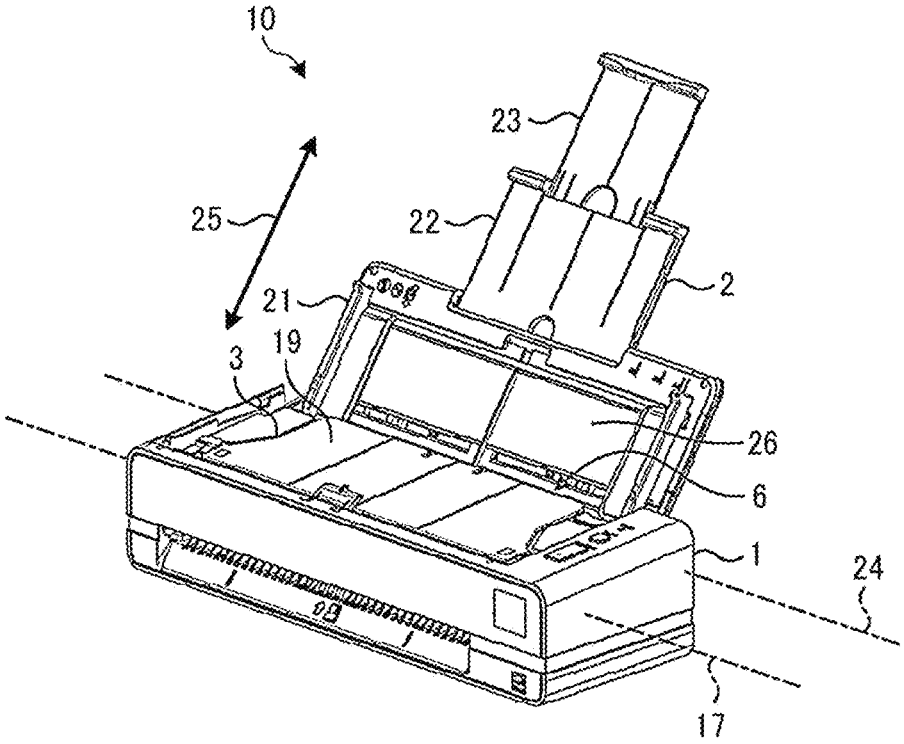
FIG. 3 is a perspective view of the image reading apparatus according to the first embodiment when the media tray is properly deployed and the ejection tray is properly stored.

As illustrated in FIG. 3, the ejection tray 3 is properly stored in the medium conveying apparatus body 1 when the ejection tray body 14 is positioned at the ejection-tray stored position. FIG. 3 is a perspective view of the image reading apparatus 10 when the media tray 2 is properly deployed and the ejection tray 3 is properly stored. When the ejection tray 3 is properly stored, the ejection-tray placement surface 19 of the ejection tray 3 faces upward, and the ejection tray 3 is positioned along the upper face of the medium conveying apparatus body 1.

The media tray 2 includes a media tray body 21, a first media-tray extension 22, and a second media-tray extension 23. The media tray body 21 is plate shaped. The media tray body 21 is supported by the medium conveying apparatus body 1 to swing about a swing axis 24. The swing axis 24 is parallel to both of the swing axis 17 and the plane along which the media tray body 21 lies. The media tray body 21 swings about the swing axis 24 and is positioned at a media-tray deployed position or a media-tray stored position.

The first media-tray extension 22 is plate shaped. The first media-tray extension 22 is located along the plane on which the media tray body 21 lies. The first media-tray extension 22 is supported by the media tray body 21 to move in translation in a media-tray extension-retraction direction 25. The media-tray extension-retraction direction 25 is perpendicular to the swing axis 24 and parallel to the plane along which the media tray body 21 lies. The first media-tray extension 22 moves in translation in the media-tray extension-retraction direction 25 and is positioned at the first media-tray retracted position or the first media-tray extended position.

The second media-tray extension 23 is plate shaped. The second media-tray extension 23 is located along the plane on which the media tray body 21 lies. The second media-tray extension 23 is supported by the first media-tray extension 22 to be translated in the media-tray extension-retraction direction 25. The second media-tray extension 23 can be translated in the media-tray extension-retraction direction 25 and is positioned at the second media-tray retracted position or the second media-tray extended position.

The media tray 2 includes a media-tray placement surface 26. The media-tray placement surface 26 is formed by the surface of the media tray body 21, the surface of the first media-tray extension 22, and the surface of the second media-tray extension 23. The media-tray placement surface 26 is substantially flat and along the plane along which the media tray body 21 lies.

The media tray 2 is properly extended when the first media-tray extension 22 is positioned at the first media-tray extended position and the second media-tray extension 23 is positioned at the second media-tray extended position. When the media tray 2 is properly extended, the length of the media tray 2 in the media-tray extension-retraction direction 25 is maximized, and the area of the media-tray placement surface 26 is maximized. The media tray 2 is properly deployed when the media tray 2 is properly extended and the media tray body 21 is positioned at the media-tray deployed position. When the media tray 2 is properly deployed, the media-tray placement surface 26 of the media tray 2 is connected to the feed opening 6. When the media tray body 21 is positioned at the media-tray deployed position, the media-tray placement surface 26 of the media tray 2 faces obliquely upward.

When the second media-tray extension 23 is positioned at the second media-tray retracted position, the second media-tray extension 23 is positioned inside the first media-tray extension 22. When the first media-tray extension 22 is positioned at the first media-tray retracted position, the first media-tray extension 22 is positioned inside the media tray body 21. The media tray 2 is properly retracted when the first media-tray extension 22 is positioned at the first media-tray retracted position and the second media-tray extension 23 is positioned at the second media-tray retracted position. When the media tray 2 is properly retracted, the area of the media-tray placement surface 26 is minimized.

Figure 4:
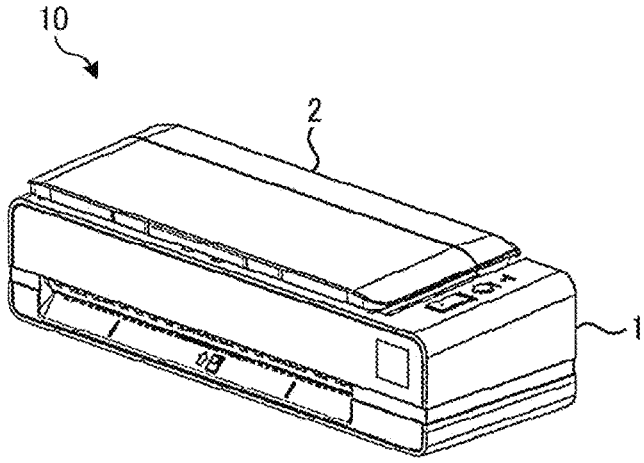
FIG. 4 is a perspective view of the image reading apparatus according to the first embodiment when the media tray and the ejection tray are properly stored.

The media tray 2 is properly stored in the medium conveying apparatus body 1 as illustrated in FIG. 4 when the ejection tray 3 is properly stored, the media tray 2 is properly retracted, and the media tray body 21 is positioned at the media-tray stored position. FIG. 4 is a perspective view of the image reading apparatus 10 when the media tray 2 and the ejection tray 3 are properly stored. When the media tray 2 is properly stored, the media-tray placement surface 26 of the media tray 2 faces the ejection tray 3. When the media tray 2 is properly stored, the ejection tray 3 is positioned between the medium conveying apparatus body 1 and the media tray 2. The height of the image reading apparatus 10 when the media tray 2 is properly stored is lower than the height of the image reading apparatus 10 when the media tray 2 is properly deployed. Thus, when the ejection tray 3 and the media tray 2 are properly stored, the image reading apparatus 10 can be stored in a small space. The ejection opening 7 is closed by the media tray 2 when the media tray 2 is properly stored. The ejection opening 7 is closed when the media tray 2 is properly stored. Accordingly, the image reading apparatus 10 can prevent foreign objects from entering the conveying path 8 from the ejection opening 7.

Figure 5:
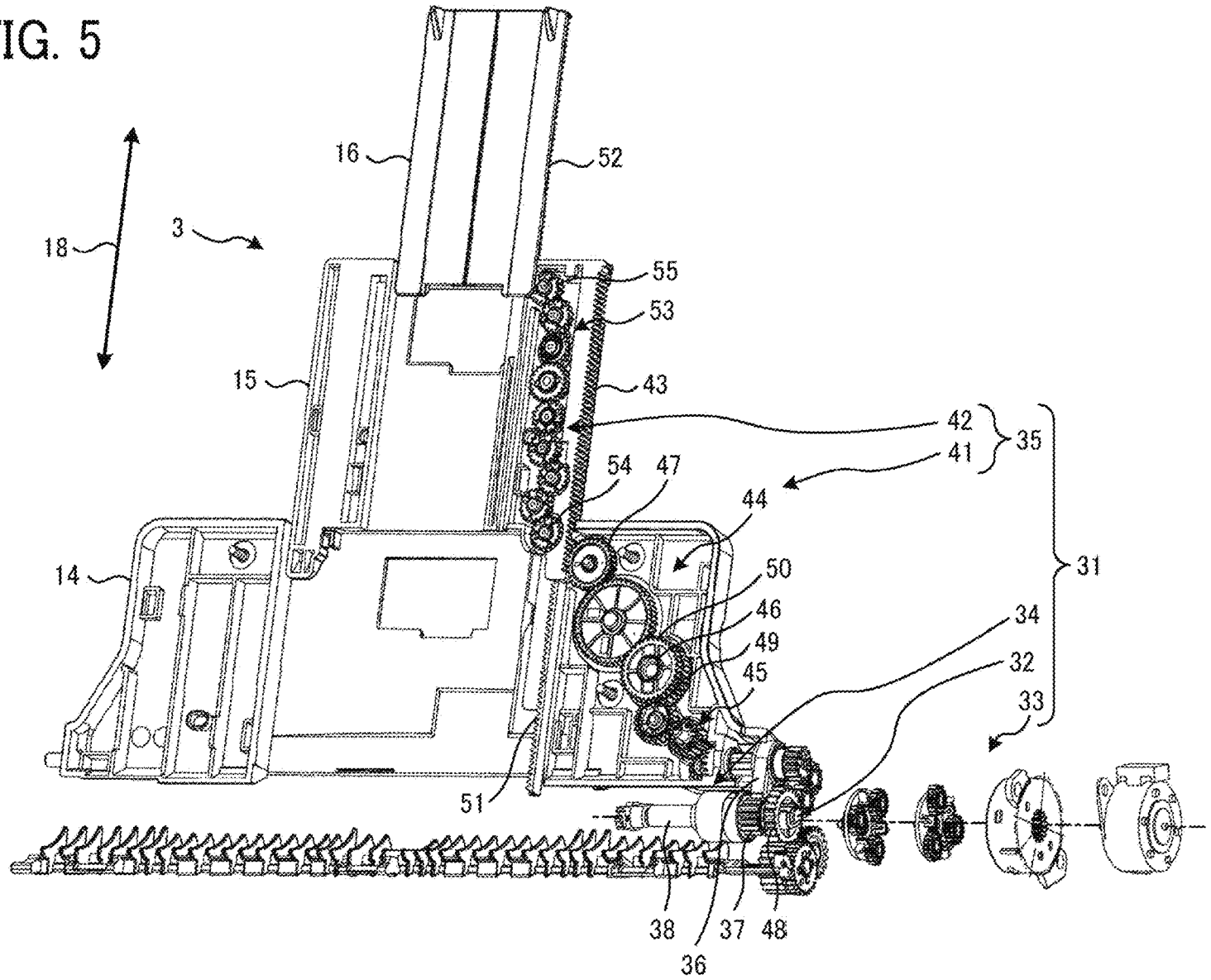
FIG. 5 is an exploded perspective view of an ejection-tray deploying-storing mechanism according to the first embodiment.

The image reading apparatus 10 further includes an ejection-tray deploying-storing mechanism 31 as illustrated in FIG. 5. FIG. 5 is an exploded perspective view of the ejection-tray deploying-storing mechanism 31. The ejection-tray deploying-storing mechanism 31 includes a drive shaft 32, a motor 33 for deploying and storing the ejection tray 3, a deploying-storing mechanism 34, and an extension-retraction mechanism 35. The deploying-storing mechanism 34 is an example of a "first mechanism," and the extension-retraction mechanism 35 is an example of a "second mechanism." The drive shaft 32 is located inside the medium conveying apparatus body 1 and is rotatably supported by the medium conveying apparatus body 1. The motor 33 is located inside the medium conveying apparatus body 1. The motor 33 rotates the drive shaft 32 in the forward direction or the reverse direction.

The deploying-storing mechanism 34 swings the ejection tray body 14 toward the ejection-tray deployed position when the drive shaft 32 rotates in the forward direction. The deploying-storing mechanism 34 swings the ejection tray body 14 toward the ejection-tray stored position when the drive shaft 32 rotates in the reverse direction. Specifically, the deploying-storing mechanism 34 includes a sector gear 36, a first gear 37, and a torque limiter 38. The sector gear 36 is fixed to the ejection tray body 14. The first gear 37 is rotatably supported by the medium conveying apparatus body 1. The first gear 37 meshes with the sector gear 36. The torque limiter 38 transmits the rotation of the drive shaft 32 to the first gear 37. The torque limiter 38 does not transmit the rotation of the drive shaft 32 to the first gear 37 when the load applied between the first gear 37 and the sector gear 36 is greater than a predetermined threshold.

The deploying-storing mechanism 34 further includes a deploying-side stopper and a storing-side stopper. The deploying-side stopper is fixed to the medium conveying apparatus body 1. The extension stopper does not contact the ejection tray body 14 when the ejection tray body 14 is not at the ejection-tray deployed position but contacts the ejection tray body 14 when the ejection tray body 14 is at the ejection-tray deployed position. The storing-side stopper is fixed to the medium conveying apparatus body 1. The storing-side stopper does not contact the ejection tray body 14 when the ejection tray body 14 is not at the ejection-tray stored position but contacts the ejection tray body 14 when the ejection tray body 14 is at the ejection-tray stored position.

The extension-retraction mechanism 35 includes a first extension-retraction mechanism 41 and a second extension-retraction mechanism 42. The first extension-retraction mechanism 41 translates the first ejection-tray extension 15 toward the first ejection-tray extended position when the drive shaft 32 rotates in the forward direction. Further, the first extension-retraction mechanism 41 translates the first ejection-tray extension 15 toward the first ejection-tray retracted position when the drive shaft 32 rotates in the reverse direction. Specifically, the first extension-retraction mechanism 41 includes a rack 43, a second gear train 44, a third gear train 45, and a torque limiter 46. The rack 43 is parallel to the ejection-tray extension-retraction direction 18 and is fixed to the first ejection-tray extension 15. The gears of the second gear train 44 are rotatably supported by the ejection tray body 14 and mesh with one another. The second gear train 44 includes a gear 47 meshing with the rack 43. The gears of the third gear train 45 are rotatably supported by the ejection tray body 14 and mesh with one another. The third gear train 45 includes a gear 48 fixed to the drive shaft 32. The torque limiter 46 transmits the rotation of another gear 50 of the third gear train 45 to another gear 49 of the second gear train 44. The torque limiter 46 does not transmit the rotation of the gear 50 to the gear 49 when the load applied between the gear 49 and the gear 50 is greater than a predetermined threshold.

The first extension-retraction mechanism 41 further includes an extension stopper and a retraction stopper. The extension stopper is fixed to the ejection tray body 14. The extension stopper does not contact the first ejection-tray extension 15 when the first ejection-tray extension 15 is not at the first ejection-tray extended position but contacts the first ejection-tray extension 15 when the first ejection-tray extension 15 is at the first ejection-tray extended position. The retraction stopper is fixed to the ejection tray body 14. The retraction stopper does not contact the first ejection-tray extension 15 when the first ejection-tray extension 15 is not at the first ejection-tray retracted position but contacts the first ejection-tray extension 15 when the first ejection-tray extension 15 is at the first ejection-tray retracted position.

The second extension-retraction mechanism 42 includes a first rack 51, a second rack 52, and a fourth gear train 53. The first rack 51 is parallel to the ejection-tray extension-retraction direction 18 and is fixed to the ejection tray body 14. The second rack 52 is parallel to the ejection-tray extension-retraction direction 18 and is fixed to the second ejection-tray extension 16. The gears of the fourth gear train 53 are rotatably supported by the first ejection-tray extension 15 and mesh with one another.

The fourth gear train 53 includes a gear 54 meshing with the first rack 51. The fourth gear train 53 further includes a gear 55 meshing with the second rack 52.

The second extension-retraction mechanism 42 moves the second ejection-tray extension 16 in translation toward the second ejection-tray extended position when the first ejection-tray extension 15 moves in translation toward the first ejection-tray extended position. Further, the second extension-retraction mechanism 42 positions the second ejection-tray extension 16 at the second ejection-tray extended position when the first ejection-tray extension 15 is positioned at the first ejection-tray extended position. The second extension-retraction mechanism 42 moves the second ejection-tray extension 16 in translation toward the second ejection-tray retracted position when the first ejection-tray extension 15 moves in translation toward the first ejection-tray retracted position. Further, the second extension-retraction mechanism 42 positions the second ejection-tray extension 16 at the second ejection-tray retracted position when the first ejection-tray extension 15 is positioned at the first ejection-tray retracted position.

Figure 6:
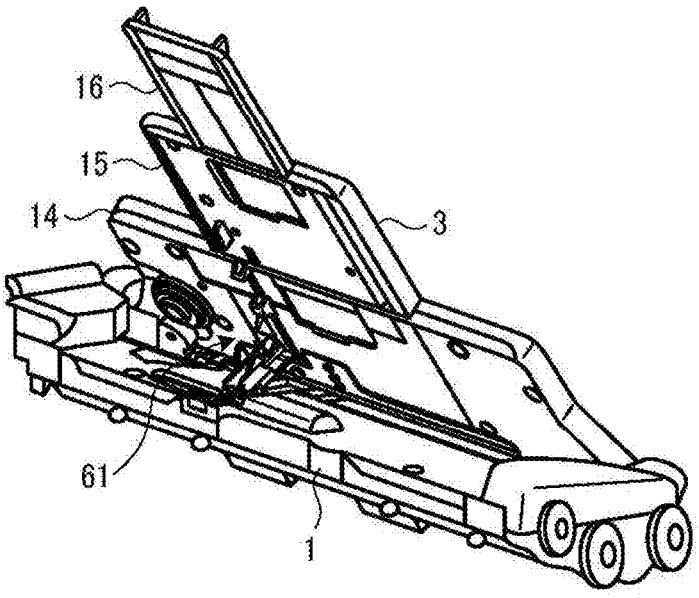
FIG. 6 is a perspective view of the ejection tray and an ejection-tray stopping mechanism of the ejection-tray deploying-storing mechanism illustrated in FIG. 5.
Figure 7:
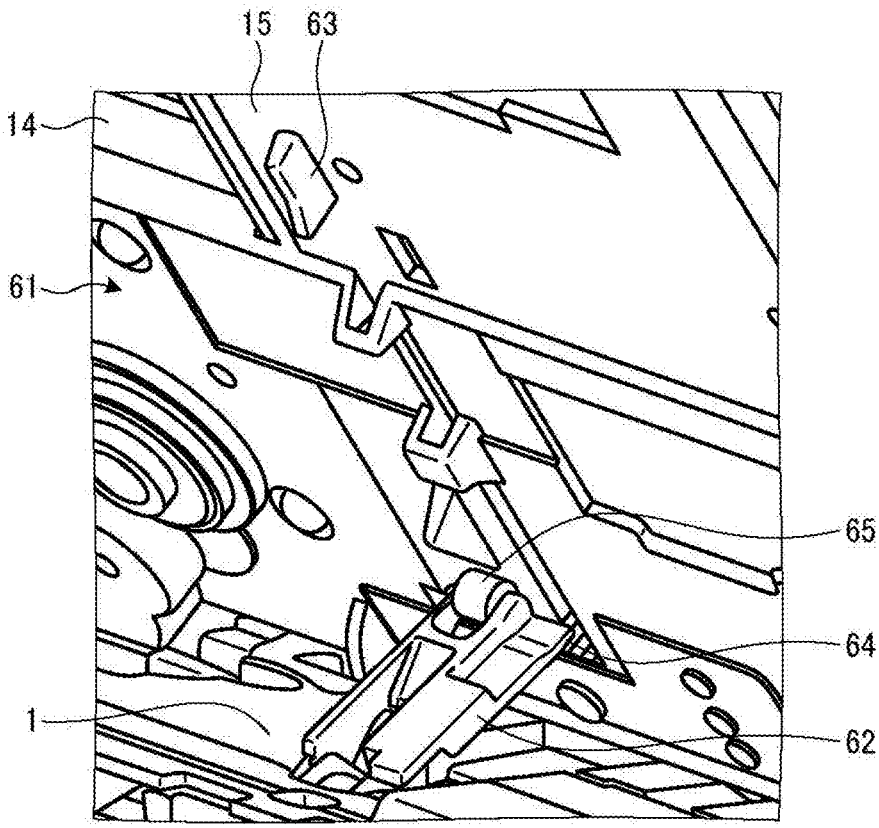
FIG. 7 is an enlarged perspective view of the ejection-tray stopping mechanism illustrated in FIG. 6 when an ejection tray body is positioned at a midway position between a deployed position and a stored position.

The deploying-storing mechanism 34 further includes an ejection-tray stopping mechanism 61 as illustrated in FIG. 6. FIG. 6 is a perspective view of the ejection tray 3 and the ejection-tray stopping mechanism 61. As illustrated in FIG. 6, the ejection tray body 14 is at the midway position while the ejection tray body 14 swings from the ejection-tray deployed position to the ejection-tray stored position. FIG. 7 is an enlarged perspective view of the ejection-tray stopping mechanism 61 when the ejection tray body 14 is at the midway position. The ejection-tray stopping mechanism 61 includes a stopper 62 and a stopper releaser 63. The stopper 62 includes a stopper body 64 and a roller 65. The stopper body 64 is substantially band shaped. The stopper body 64 is supported by the medium conveying apparatus body 1 swingably about a swing axis that is parallel to the swing axis 17. The stopper 62 is positioned at a tray retaining position or the tray releasing position by the swinging of the stopper body 64. The stopper body 64 extends along a virtual straight line approximately perpendicular to the plane along which the ejection tray body 14 lies when the stopper 62 is positioned at the tray retaining position and the ejection tray body 14 is positioned at the midway position.

The roller 65 is columnar. The roller 65 is located at one end of the stopper body 64 and is supported by the stopper body 64 rotatably about a rotation axis that is parallel to the swing axis 17. When the stopper 62 is positioned at the tray retaining position and the ejection tray body 14 is positioned at the midway position, the roller 65 contacts the ejection tray body 14, and when the ejection tray body 14 is positioned at the ejection-tray deployed position, the roller 65 does not contact the ejection tray body 14.

Figure 21:
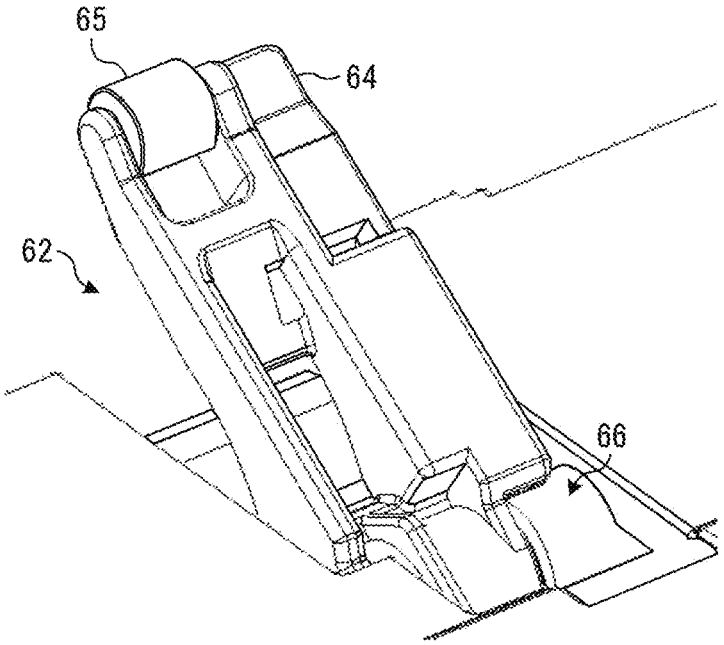
FIG. 21 is a perspective view of a stopper of the ejection-tray stopping mechanism illustrated in FIGS. 6 and 7.

The ejection-tray stopping mechanism 61 further includes a torsion coil spring 66 (a biasing spring) as illustrated in FIG. 21. The torsion coil spring 66 exerts an elastic force on the stopper body 64 to swing the stopper 62 toward the tray retaining position so that the stopper 62 is positioned at the tray retaining position. The stopper releaser 63 is located on a face of the first ejection-tray extension 15 opposite to the ejection-tray placement surface 19 and is fixed to the first ejection-tray extension 15.

Figure 8:
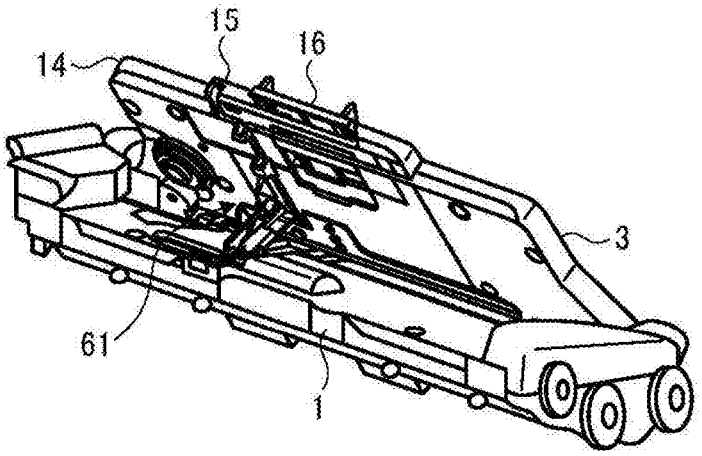
FIG. 8 is a perspective view of the ejection tray and the ejection-tray stopping mechanism illustrated in FIG. 6 when the first ejection-tray extension is at a first extension-tray extension midway position.
Figure 9:
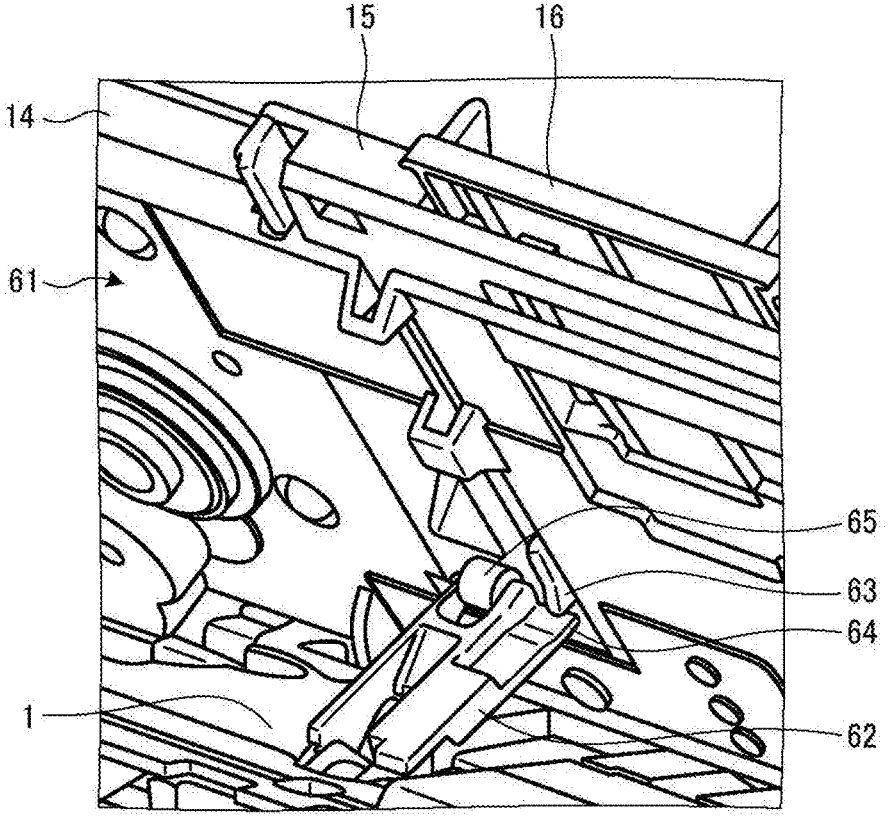
FIG. 9 is an enlarged perspective view of the ejection-tray stopping mechanism when the first ejection-tray extension is at the first extension-tray extension midway position as illustrated in FIG. 8.

The first ejection-tray extension 15 is positioned at the first extension-tray extension midway position as illustrated in FIG. 8 in midway of translating from the first ejection-tray extended position to the first ejection-tray retracted position. FIG. 8 is a perspective view of the ejection tray 3 and the ejection-tray stopping mechanism 61 when the first ejection-tray extension 15 is positioned at the first extension-tray extension midway position. In the ejection-tray stopping mechanism 61, the stopper releaser 63 contacts the stopper body 64 as illustrated in FIG. 9 when the ejection tray body 14 is positioned at the midway position and the first ejection-tray extension 15 is positioned at the first extension-tray extension midway position. FIG. 9 is an enlarged perspective view of the ejection-tray stopping mechanism 61 when the first ejection-tray extension 15 is at the first extension-tray extension midway position. In the ejection-tray stopping mechanism 61, the stopper releaser 63 pushes the stopper body 64 to swing the stopper 62 toward the tray releasing position when the first ejection-tray extension 15 moves in translation from the first extension-tray extension midway position toward the first ejection-tray retracted position. In the ejection-tray stopping mechanism 61, the roller 65 moves away from the ejection tray body 14 positioned at the midway position as the stopper 62 swings toward the tray releasing position.

That is, the ejection-tray stopping mechanism 61 does not allow the ejection tray body 14 to be positioned closer to the ejection-tray stored position than the midway position when the stopper 62 is at the tray retaining position. By contrast, the ejection-tray stopping mechanism 61 allows the ejection tray body 14 to swing from the midway position toward the ejection-tray stored position when the stopper 62 swings from the tray retaining position to the tray releasing position. The ejection-tray stopping mechanism 61 allows the ejection tray body 14 to be positioned at the ejection-tray stored position when the stopper 62 is at the tray releasing position.

Figure 10:
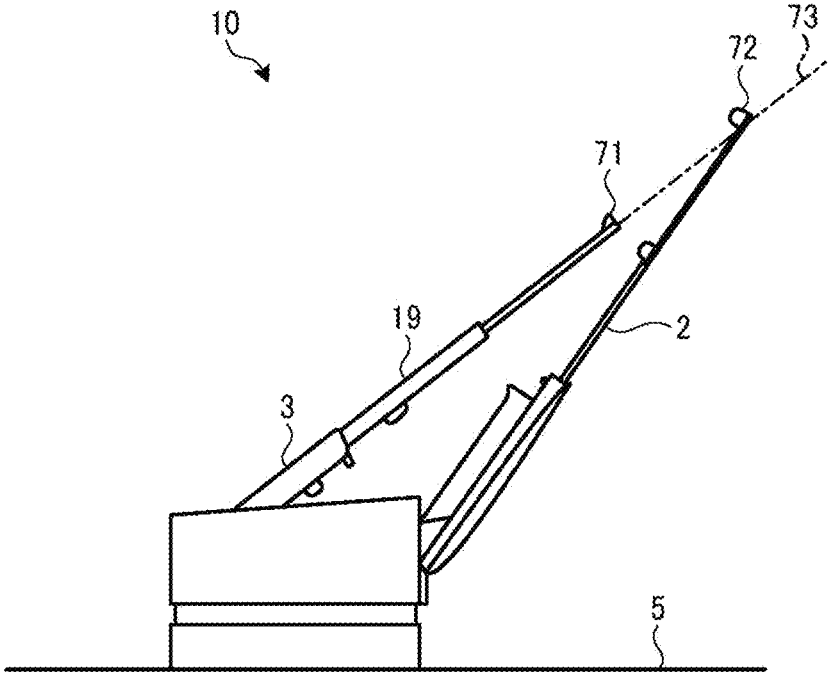
FIG. 10 is a side view of the image reading apparatus according to the first embodiment when the ejection tray body is at the midway position.

The ejection tray 3 does not contact the media tray 2 when the media tray 2 is properly deployed, the ejection tray 3 is properly extended, and the ejection tray body 14 is positioned at the midway position as illustrated in FIG. 10. FIG. 10 is a side view of the image reading apparatus 10 when the ejection tray body 14 is at the midway position. When the media tray 2 is properly deployed and the ejection tray body 14 is positioned at the midway position, a plane 73 along which the ejection-tray placement surface 19 of the ejection tray 3 lies intersects with the media tray 2.

Operation of Image Reading Apparatus 10

Figure 11:
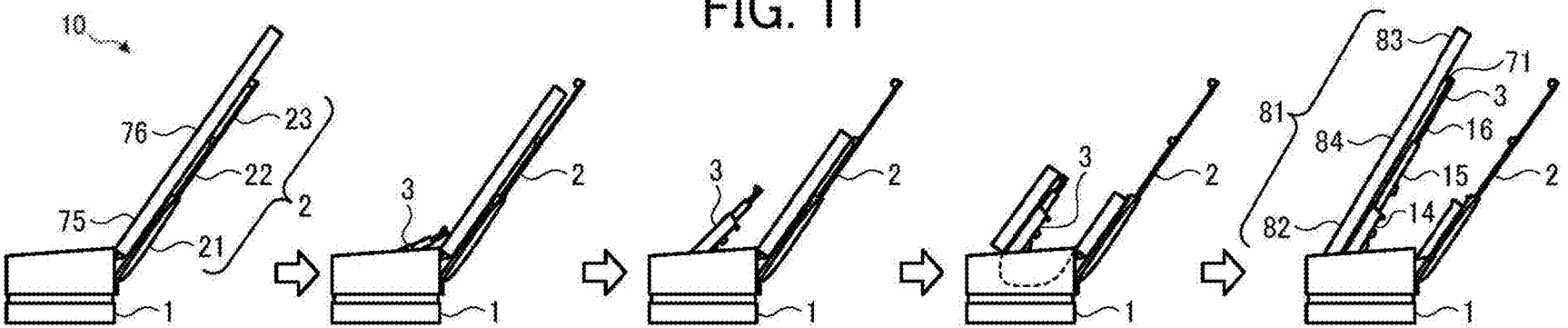
FIG. 11 is a transition diagram depicting an operation of the image reading apparatus according to the first embodiment and the behavior of a medium viewed from the side.

When a user wishes to use the image reading apparatus 10 to read the image of a medium of a specified size (for example, A4 size), the user deploys the media tray 2. When the media tray 2 is properly deployed, the user places a medium 75 on the media-tray placement surface 26 (see FIG. 3) of the media tray 2 as illustrated in FIG. 11. FIG. 11 is a transition diagram depicting the behaviors of the image reading apparatus 10 and the medium 75 thereon viewed from the side. At this time, a portion 76 of the medium 75 not on the media tray body 21 is placed on the first media-tray extension 22 and the second media-tray extension 23. The image reading apparatus 10 can prevent the medium 75 from slipping relative to the media tray 2 or falling off the media tray 2 due to the weight of the portion 76 by supporting the portion 76 with the first media-tray extension 22 and the second media-tray extension 23. The medium 75 placed on the media tray 2 moves by the gravity toward the feed opening 6 and are inserted into the feed opening 6 because the media-tray placement surface 26 faces diagonally upward. The user starts the image reading apparatus 10 after the medium 75 is inserted into the feed opening 6. Although only one medium is depicted in FIG. 11 for the purpose of simplifying the explanation, multiple media can be inserted into the feed opening 6 and placed on the ejection tray 3.

The ejection-tray deploying-storing mechanism 31 deploys the ejection tray 3 after the image reading apparatus 10 is started. That is, after the image reading apparatus 10 is started, the motor 33 rotates the drive shaft 32 in the forward direction. When the drive shaft 32 rotates in the forward direction, the ejection tray body 14 is swung by the deploying-storing mechanism 34 to the ejection-tray deployed position. When the ejection tray body 14 is at the ejection-tray deployed position, the ejection tray body 14 contacts the deploying-side stopper and stops swinging. When the ejection tray body 14 stops swinging while the drive shaft 32 rotates in the forward direction, a load greater than the threshold is applied between the drive shaft 32 and the first gear 37 of the deploying-storing mechanism 34. When a load greater than the threshold is applied between the drive shaft 32 and the first gear 37, the torque limiter 38 prevents the rotation of the drive shaft 32 from being transmitted to the first gear 37. Since the rotation of the drive shaft 32 is not transmitted to the first gear 37, the ejection tray body 14 is secured to the medium conveying apparatus body 1 with the position thereof retained at the ejection-tray deployed position.

When the drive shaft 32 rotates in the forward direction, the first ejection-tray extension 15 is translated toward the first ejection-tray extended position by the first extension-retraction mechanism 41 and is positioned at the first ejection-tray extended position. When the first ejection-tray extension 15 is positioned at the first ejection-tray extended position, the first ejection-tray extension 15 contacts the extension stopper of the first extension-retraction mechanism 41 and stops translating. When the first ejection-tray extension 15 stops translating while the drive shaft 32 rotates in the forward direction, a load greater than the threshold is applied between the gear 49 and the gear 50. When a load greater than the threshold is applied between the gear 49 and the gear 50, the torque limiter 46 prevents the rotation of gear 49 from being transmitted to the gear 50. Since the rotation of gear 49 is not transmitted to gear 50, the first ejection-tray extension 15 is secured to the ejection tray body 14 with the position thereof retained at the first ejection-tray extended position.

When the first ejection-tray extension 15 is translated toward the first ejection-tray extended position, the second extension-retraction mechanism 42 translates the second ejection-tray extension 16 toward the second ejection-tray extended position. When the first ejection-tray extension 15 is positioned at the first ejection-tray extended position, the second extension-retraction mechanism 42 positions the second ejection-tray extension 16 at the second ejection-tray extended position. The ejection-tray deploying-storing mechanism 31 can keep the ejection tray 3 in a properly deployed state because the motor 33 keeps rotating the drive shaft 32 in the forward direction.

When multiple media are placed on the media tray 2 and inserted into the feed opening 6, the conveyor 11 feeds one medium that is placed at the top of the media inserted into the feed opening 6 to the conveying path 8 in parallel with the deploying of the ejection tray 3 after the image reading apparatus 10 is started. Further, the conveyor 11 conveys the fed medium along the conveying path 8. The image reader 12 captures an image of the medium conveyed along the conveying path 8. The conveyor 11 ejects the medium conveyed along the conveying path 8 from the ejection opening 7 and places the ejected medium on the ejection tray 3. When multiple media are inserted into the feed opening 6, the conveyor 11 repeatedly conveys the media and the image reader 12 repeatedly captures respective images of the media until all the multiple media are placed on the ejection tray 3.

Figure 12:
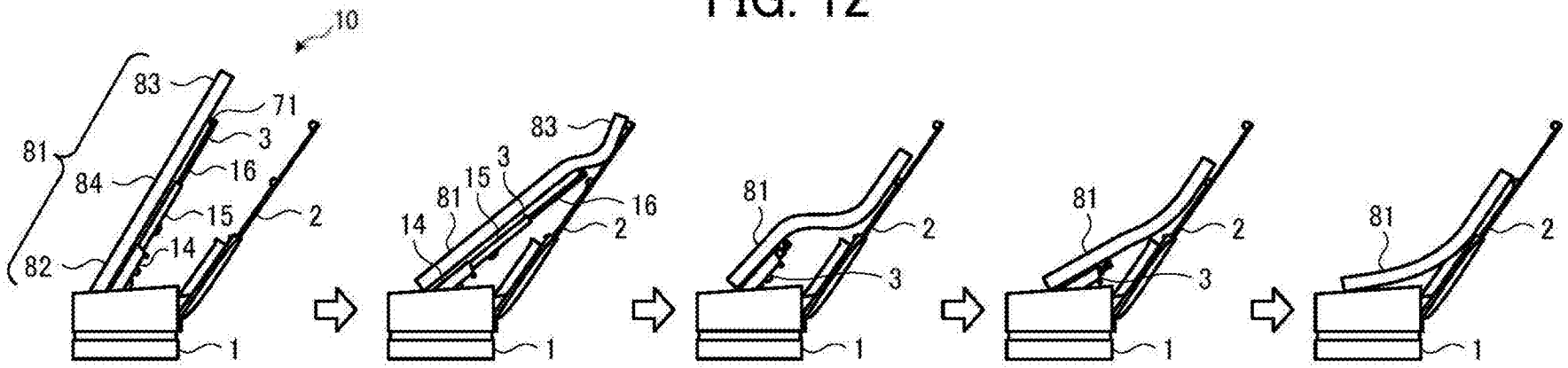
FIG. 12 is a transition diagram depicting an operation of the image reading apparatus according to the first embodiment and the behavior of the medium viewed from the side when the ejection tray is stored.

A medium 81 placed on the ejection tray 3 is sectioned into a tray body facing portion 82, a protruding portion 83, and an extension facing portion 84 for the purpose of explanation (see FIG. 12). Although only one medium is depicted in FIG. 12 for the purpose of simplifying the explanation, multiple media can be inserted into the feed opening 6 and placed on the ejection tray 3. The tray body facing portion 82 is the lower end portion of the medium 81 and is placed on the ejection tray body 14. The protruding portion 83 is the upper end portion of the medium 81 and protrudes beyond an upper end 71 of the ejection tray 3. Thus, the ejection tray 3 is formed such that the upper end of a specified-size medium placed on the ejection tray 3 protrudes beyond the ejection tray 3. In other words, the length of the ejection tray 3 that is properly extended in the ejection-tray extension-retraction direction 18 is shorter than the length of the specified-size medium.

The extension facing portion 84 of the medium 81 is a portion between the tray body facing portion 82 and the protruding portion 83 and is placed on the first ejection-tray extension 15 or the second ejection-tray extension 16. The image reading apparatus 10 can prevent the medium 81 from shifting relative to the ejection tray 3 or falling off the ejection tray 3 due to the weight of the extension facing portion 84 by supporting the extension facing portion 84 with the first ejection-tray extension 15 or the second ejection-tray extension 16.

After the medium 81 is placed on the ejection tray 3, the ejection-tray deploying-storing mechanism 31 stores the ejection tray 3 as illustrated in FIG. 12. FIG. 12 is a transition diagram depicting the operation of the image reading apparatus 10 and the behavior of the medium 81 viewed from the side when the ejection tray 3 is stored. After the medium 81 is placed on the ejection tray 3, the motor 33 initially rotates the drive shaft 32 in the reverse direction. When the drive shaft 32 rotates in the reverse direction, the ejection tray 3 is retracted by the extension-retraction mechanism 35. Specifically, when the drive shaft 32 rotates in the reverse direction, the first extension-retraction mechanism 41 moves the first ejection-tray extension 15 in translation toward the first ejection-tray retracted position. When the first ejection-tray extension 15 is translated toward the first ejection-tray retracted position, the second extension-retraction mechanism 42 translates the second ejection-tray extension 16 toward the second ejection-tray retracted position.

When the drive shaft 32 rotates in the reverse direction, the ejection tray body 14 is swung by the deploying-storing mechanism 34 toward the ejection-tray stored position and is positioned at the midway position. When the ejection tray body 14 is at the midway position, the ejection-tray stopping mechanism 61 restrains the ejection tray body 14 at the midway position so that the ejection tray body 14 is secured to the medium conveying apparatus body 1 at the midway position. That is, when the ejection tray body 14 is at the midway position, the ejection tray body 14 contacts the rollers 65 of the stopper 62 of the ejection-tray stopping mechanism 61. When the ejection tray body 14 contacts the stopper 62, the ejection tray body 14 is restrained by the ejection-tray stopping mechanism 61 and stops swinging toward the ejection-tray stored position. When the ejection tray body 14 stops swinging while the drive shaft 32 rotates in the reverse direction, a load greater than the threshold is applied between the drive shaft 32 and the first gear 37. When a load greater than the threshold is applied between the drive shaft 32 and the first gear 37, the torque limiter 38 prevents the rotation of the drive shaft 32 from being transmitted to the first gear 37. Since the rotation of the drive shaft 32 is not transmitted to the first gear 37, the ejection tray body 14 is secured to the medium conveying apparatus body 1 at the midway position.

When the ejection tray body 14 is at the midway position, the protruding portion 83 of the medium 81 contacts the media tray 2 and placed on the media tray 2 because the plane 73 (see FIG. 10) along which the ejection-tray placement surface 19 lies intersects with the media tray 2. In other words, the media tray 2 and the ejection tray 3 are formed such that a portion of the specified-size medium placed on the ejection tray 3 contacts the media tray 2 when the ejection tray body 14 is positioned at the midway position.

When the medium 81 is placed on the ejection tray 3, a load is applied to the ejection tray 3 from the medium 81. When multiple media are placed on the ejection tray 3, the load applied to the ejection tray 3 from the media increases the frictional force that resists the retraction of the ejection tray 3. When the multiple media are placed on the ejection tray 3, for example, a frictional force resisting the translational motion of the first ejection-tray extension 15 relative to the ejection tray body 14 acts between the first ejection-tray extension 15 and the media. Further, a frictional force resisting the translational motion of the second ejection-tray extension 16 relative to the ejection tray body 14 acts between the second ejection-tray extension 16 and the media due to the media placed on the ejection tray 3. Furthermore, the ejection tray 3 may be deformed by the gravity of the media placed on the ejection tray 3. The frictional force acting between the ejection tray body 14 and the first ejection-tray extension 15 and the frictional force acting between the first ejection-tray extension 15 and the second ejection-tray extension 16 increase as the degree of the deformation of the ejection tray 3 increases.

The load applied to the ejection tray 3 from the media is reduced when the protruding portion 83 is placed on the media tray 2. The frictional force resisting the retraction of the ejection tray 3 is reduced as the load applied to the ejection tray 3 from the media decreases. The load applied between the gear 49 and the gear 50 of the extension-retraction mechanism 35 is reduced below the threshold due to the reduction in the force resisting the retraction of the ejection tray 3. The rotation of gear 49 is transmitted to the gear 50 by torque limiter 46 when the load applied between the gear 49 and the gear 50 decreases smaller than the threshold. When the rotation of the gear 49 is transmitted to the gear 50, the first ejection-tray extension 15 is translated toward the first ejection-tray retracted position and is positioned at the first extension-tray extension midway position. In other words, the image reading apparatus 10 can retract the ejection tray 3 with a small force by reducing the frictional force resisting the retraction of the ejection tray 3. The image reading apparatus 10 can reduce the capacity required for the motor 33 to generate the driving force to retract the ejection tray 3 because the ejection tray 3 can be retracted with a small force. Accordingly, the motor 33 can be compact, and the size of the apparatus can be reduced.

The stopper releaser 63 of the ejection-tray stopping mechanism 61 contacts the stopper body 64 when the first ejection-tray extension 15 is at the first extension-tray extension midway position. After the stopper releaser 63 contacts the stopper body 64, the first ejection-tray extension 15 is further translated toward the first ejection-tray retracted position. When the first ejection-tray extension 15 is translated to the first ejection-tray retracted position from the first extension-tray extension midway position, the stopper releaser 63 pushes the stopper body 64, and the stopper 62 swings toward the tray releasing position. When the stopper 62 swings toward the tray releasing position, the roller 65 rolls on the ejection tray body 14 and reduces the frictional force acting between the stopper 62 and the ejection tray body 14. When the stopper 62 swings toward the tray releasing position, the ejection-tray stopping mechanism 61 releases the ejection tray body 14 and allows the ejection tray body to 14 swing toward the ejection-tray stored position. The ejection tray body 14 swings toward the ejection-tray stored position after the ejection tray body 14 is released from the ejection-tray stopping mechanism 61, i.e., after the first ejection-tray extension 15 passes through the first extension-tray extension midway position. In other words, the deploying-storing mechanism 34 resumes the swinging of the ejection tray body 14 toward the ejection-tray stored position after the ejection tray 3 is sufficiently retracted such that the first ejection-tray extension 15 is positioned at the first extension-tray extension midway position.

After the first ejection-tray extension 15 is positioned at the first extension-tray extension midway position, the first ejection-tray extension 15 is further translated to the first ejection-tray retracted position and contacts the retraction stopper. When the first ejection-tray extension 15 contacts the retraction stopper, the first ejection-tray extension 15 stops translating. When the first ejection-tray extension 15 stops moving, a load greater than the threshold is applied between the gear 49 and the gear 50. When a load greater than the threshold is applied between the gear 49 and the gear 50, the torque limiter 46 prevents the rotation of gear 49 from being transmitted to the gear 50. Since the rotation of gear 49 is not transmitted to gear 50, the first ejection-tray extension 15 is retained at the first ejection-tray retracted position and secured to the ejection tray body 14.

When the first ejection-tray extension 15 is translated toward the first ejection-tray retracted position, the second extension-retraction mechanism 42 translates the second ejection-tray extension 16 toward the second ejection-tray retracted position. When the first ejection-tray extension 15 is at the first ejection-tray retracted position, the second extension-retraction mechanism 42 positions the second ejection-tray extension 16 at the second ejection-tray retracted position. The ejection tray 3 is properly retracted when the second ejection-tray extension 16 is at the second ejection-tray retracted position.

When the ejection tray 3 is properly retracted, the ejection tray body 14 further swings to the ejection-tray stored position. When the ejection tray body 14 is positioned at the ejection-tray stored position, the ejection tray body 14 contacts the storing-side stopper and stops swinging. When the ejection tray body 14 stops swinging while the drive shaft 32 rotates in the reverse direction, a load greater than the threshold is applied between the drive shaft 32 and the first gear 37 of the deploying-storing mechanism 34. When a load greater than the threshold is applied between the drive shaft 32 and the first gear 37, the torque limiter 38 prevents the rotation of the drive shaft 32 from being transmitted to the first gear 37. Since the rotation of the drive shaft 32 is not transmitted to the first gear 37, the ejection tray body 14 is retained at the ejection-tray stored position and secured to the medium conveying apparatus body 1. When the ejection tray body 14 is positioned at the ejection-tray stored position and is secured to the medium conveying apparatus body 1, the ejection tray 3 is properly stored in the medium conveying apparatus body 1. After the ejection tray 3 is properly stored, the motor 33 stops rotating the drive shaft 32 in the reverse direction. The ejection tray 3 is secured to the medium conveying apparatus body 1 in a properly stored state since the motor 33 stops rotating the drive shaft 32 after the ejection tray 3 is properly stored.

The medium 81 placed on the ejection tray 3 are held on the image reading apparatus 10 such that a portion of the medium 81 is placed on the stored ejection tray 3 and another portion of the medium 81 is placed on the media tray 2 when the ejection tray 3 is properly stored. In other words, even when the ejection tray 3 is properly stored in the medium conveying apparatus body 1 after the medium 81 is placed on the properly deployed ejection tray 3, the image reading apparatus 10 can properly hold the medium 81 without slipping or falling off.

In order to keep the ejection tray 3 with the medium 81 placed thereon in a properly deployed state, the motor 33 needs to keep the drive shaft 32 rotating in the forward direction. Thus, the image reading apparatus 10 continuously consumes power. After the ejection tray 3 is stored, the motor 33 is stopped because it is not necessary to rotate the drive shaft 32. Thus, the power consumed by the image reading apparatus 10 can be reduced.

A medium conveying apparatus 10Z according to a comparative example, which is the same as the image reading apparatus 10 described above except that the ejection-tray stopping mechanism 61 is omitted, is described with reference to FIG. 13. Similar to the image reading apparatus 10 described above, the medium conveying apparatus 10Z deploys an ejection tray 91 and conveys the multiple media one by one along the conveying path 8 after multiple media are placed on a media tray 2 that is properly deployed. The medium conveying apparatus 10Z captures an image of the medium conveyed along the conveying path 8 and then places the medium on the properly deployed ejection tray 91.

Figure 13:
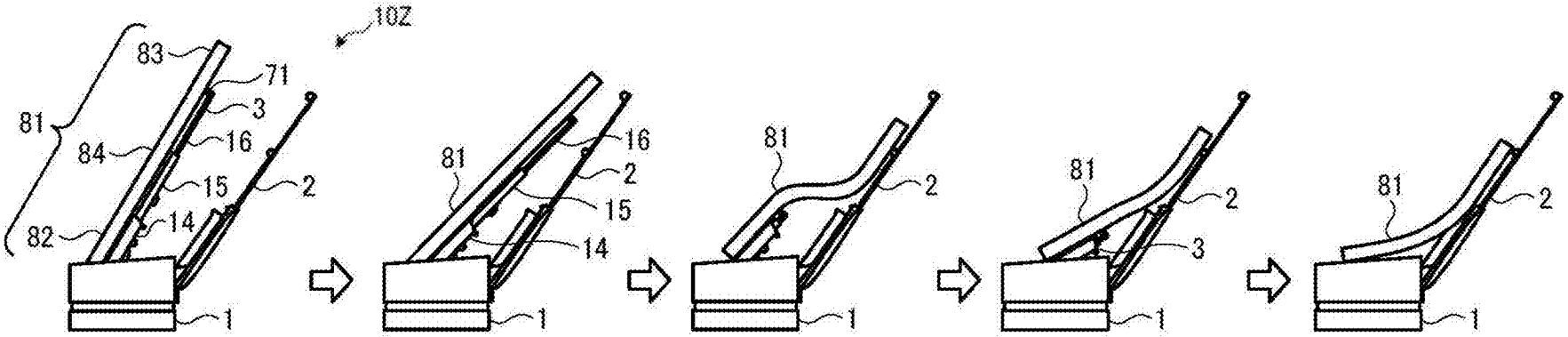
FIG. 13 is a transition diagram depicting an operation of a medium conveying apparatus according to a comparative example viewed from the side.

FIG. 13 is a transition diagram depicting the operation of the medium conveying apparatus 10Z viewed from the side. Although only one medium is depicted in FIG. 13 for the purpose of simplifying the explanation, multiple media can be inserted into the feed opening 6 and placed on the ejection tray 3. The ejection-tray deploying-storing mechanism 31 of the medium conveying apparatus 10Z stores the ejection tray 3 after all the media inserted into the feed opening 6 are placed on the ejection tray 3. That is, the ejection tray 3 is retracted after all the media inserted into the feed opening 6 are placed on the ejection tray 3. The ejection tray body 14 swings to the ejection-tray stored position in parallel with the retracting of the ejection tray 3. When the ejection tray 3 is properly retracted, the ejection tray body 14 is positioned at the ejection-tray stored position, and thus the ejection tray 3 is properly stored in the medium conveying apparatus body 1. In this comparative example of the medium conveying apparatus 10Z, the ejection tray body 14 does not stop swinging until the ejection tray body 14 reaches the ejection-tray stored position after starting the swinging.

Similar to the ejection tray 3 of the image reading apparatus 10 described above, the ejection tray 3 of the medium conveying apparatus 10Z receives a load due to the gravity of the media when the media are placed on the ejection tray 3. The load applied to the ejection tray 3 from the media increases the force that resists the ejection tray 3 from retracting. For this reason, a load greater than the threshold may be applied between the gear 49 and the gear 50 when the ejection tray 3 is properly deployed, the media are placed on the ejection tray 3, and the drive shaft 32 is rotating in reverse. When a load greater than the threshold is applied between the gear 49 and the gear 50, the torque limiter 46 prevents the rotation of gear 49 from being transmitted to the gear 50. Accordingly, when the media are placed on the ejection tray 3 and the entire gravity of the media acts on the ejection tray 3, the ejection tray 3 may not be retracted.

Figure 14:
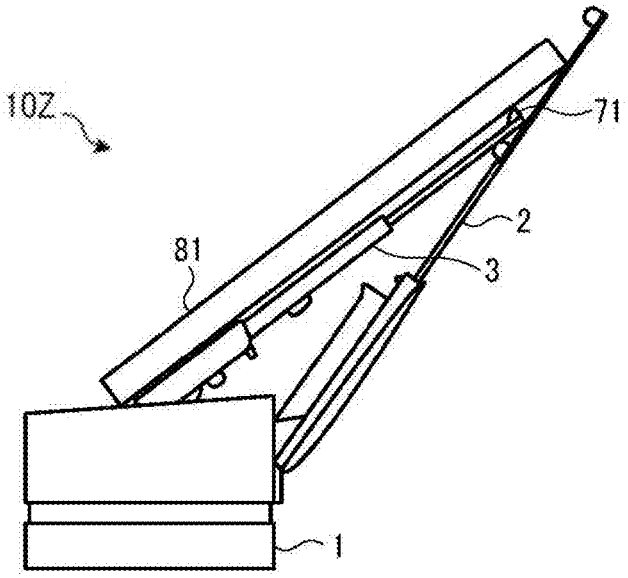
FIG. 14 is a side view of the medium conveying apparatus according to the comparative example.

When the ejection tray 3 is not retracted and the ejection tray body 14 swings toward the ejection-tray stored position, the upper end 71 of the ejection tray 3 may contact the media tray 2 as illustrated in FIG. 14. FIG. 14 is a side view of the medium conveying apparatus 10Z according to the comparative example. Although only one medium is depicted in FIG. 14 for the purpose of simplifying the explanation, multiple media can be placed on the ejection tray 3. The ejection tray 3 or the media tray 2 may be damaged when the upper end 71 of the ejection tray 3 contacts the media tray 2.

In the image reading apparatus 10 described above, the load applied to the ejection tray 3 from the media may prevent the ejection tray 3 from retracting while the ejection tray body 14 swings from the ejection-tray deployed position to the midway position similar to the medium conveying apparatus 10Z. Even if the ejection tray 3 does not retract, the image reading apparatus 10 can prevent the upper end 71 of the ejection tray 3 from contacting the media tray 2 by stopping the swinging of the ejection tray body 14 when the ejection tray body 14 is positioned at the midway position. The image reading apparatus 10 can reliably retract the ejection tray 3 by reducing the force acting against the retracting of the ejection tray 3 when the ejection tray body 14 is positioned at the midway position. Further, the image reading apparatus 10 can prevent the upper end 71 of the ejection tray 3 from contacting the media tray 2 by swinging the ejection tray body 14 from the midway position toward the ejection-tray stored position after the ejection tray 3 is sufficiently retracted. Damage to the media tray 2 and the ejection tray 3 can be prevented by preventing the upper end 71 of the ejection tray 3 from contacting the media tray 2.

The effects of the medium conveying apparatus according to the first embodiment are described. The medium conveying apparatus according to the first embodiment includes the medium conveying apparatus body 1, the media tray 2, the ejection tray 3, the conveyor 11, the deploying-storing mechanism 34, and the extension-retraction mechanism 35. The conveying path 8 is formed in the medium conveying apparatus body 1. The media tray 2 is supported by the medium conveying apparatus body 1. The ejection tray 3 is supported by the medium conveying apparatus body 1. The conveyor 11 conveys the medium placed on the media tray 2 along the conveying path 8 and places the medium on the ejection tray 3. The deploying-storing mechanism 34 swings the ejection tray 3 to be stored in the medium conveying apparatus body 1, and stops the swinging of the ejection tray 3 at a midway position between the deployed position and the stored position. The extension-retraction mechanism 35 retracts the ejection tray 3 when the ejection tray 3 stops swinging. After the ejection tray 3 is sufficiently retracted, the deploying-storing mechanism 34 resumes swinging the ejection tray 3 so that the ejection tray 3 is stored in the medium conveying apparatus body 1.

The medium conveying apparatus according to the first embodiment can reduce the frictional force resisting the retraction of the ejection tray 3 by stopping the swinging of the ejection tray 3 and then retracting the ejection tray 3 when the protruding portion 83 of the medium 81 placed on the ejection tray 3 is in contact with the media tray 2. Since the frictional force resisting the retraction of the ejection tray 3 is reduced, the ejection tray 3 can be retracted with a small force.

Further, the ejection tray 3 includes the ejection tray body 14 that is swingably supported by the medium conveying apparatus body 1 and the first ejection-tray extension 15 that is translatably supported by the ejection tray body 14. The conveyor 11 places a medium on the ejection tray 3 when the ejection tray body 14 is at the ejection-tray deployed position and the first ejection-tray extension 15 is at the first ejection-tray extended position. The ejection tray body 14 is positioned at the ejection-tray stored position when the ejection tray 3 is stored in the medium conveying apparatus body 1. The ejection tray 3 is formed such that the protruding portion 83 of the medium 81 protruding from the ejection tray 3 contacts the media tray 2 when the ejection tray body 14 is positioned at the midway position between the ejection-tray deployed position and the ejection-tray stored position. The deploying-storing mechanism 34 stops the swinging of the ejection tray body 14 when the ejection tray body 14 is positioned at the midway position between the ejection-tray deployed position and the ejection-tray stored position. When the ejection tray body 14 is at the midway position, the extension-retraction mechanism 35 translates the first ejection-tray extension 15 toward the first ejection-tray retracted position to shorten the ejection tray 3. The medium conveying apparatus according to the first embodiment stops the swinging of the ejection tray 3 and retracts the ejection tray 3 when the protruding portion 83 of the medium 81 placed on the ejection tray 3 is in contact with the media tray 2. The frictional force resisting the retraction of the ejection tray 3 can be reduced by retracting the ejection tray 3 while the protruding portion 83 is in contact with the media tray 2. Then, the ejection tray 3 can be retracted with a small force.

Further, the deploying-storing mechanism 34 includes the ejection-tray stopping mechanism 61, which includes the stopper 62, the stopper releaser 63, and the torsion coil spring 66. The stopper 62 is swingably supported by the medium conveying apparatus body 1. The stopper releaser 63 is fixed to the first ejection-tray extension 15. The torsion coil spring 66 exerts force on the stopper 62 to swing toward the tray retaining position. When the first ejection-tray extension 15 translates toward the first ejection-tray retracted position, the stopper 62 swings toward the tray releasing position due to the contact with the stopper releaser 63. When the stopper 62 is at the tray retaining position, the ejection tray body 14 contacts the stopper 62 and is secured to the medium conveying apparatus body 1 and restricted from swinging toward the ejection-tray stored position from the midway position. When the stopper 62 is at the tray releasing position, the ejection tray body 14 is released to swing toward the ejection-tray stored position. The medium conveying apparatus according to the first embodiment can be easily manufactured because neither an actuator to extend and retract the ejection tray 3 nor an actuator to swing the ejection tray 3 is used, and manufacturing cost is reduced.

The ejection tray 3 includes the ejection-tray placement surface 19 that faces the medium. When the media tray 2 is properly deployed and the ejection tray body 14 is at the midway position, the plane 73 along which the ejection-tray placement surface 19 lies intersects with the media tray 2. When the ejection tray body 14 is at the midway position, the protruding portion 83 of the medium 81 is reliably placed on the media tray 2, and the force resisting the retraction of the ejection tray 3 can be reduced.

Second Embodiment

Figure 15:
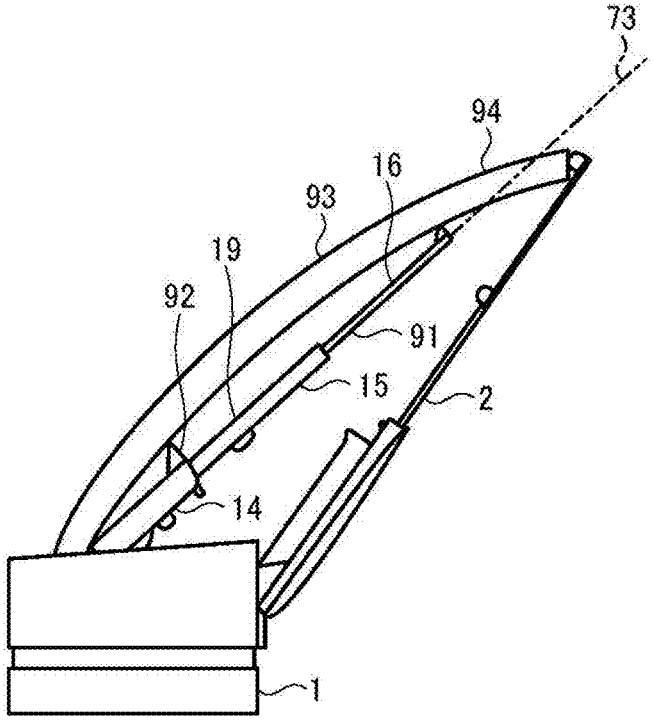
FIG. 15 is a side view of an image reading apparatus including a medium conveying apparatus according to a second embodiment.

A medium conveying apparatus according to a second embodiment is similar to the above-described medium conveying apparatus according to the first embodiment except that the above-described ejection tray 3 is replaced with an ejection tray 91 as illustrated in FIG. 15. FIG. 15 is a side view of an image reading apparatus including the medium conveying apparatus according to the second embodiment. The ejection tray 91 includes the ejection tray body 14, the first ejection-tray extension 15, and the second ejection-tray extension 16 like the ejection tray 3 described above. The ejection tray 91 includes a projection 92 projecting from the ejection-tray placement surface 19. The ejection tray 91 is formed such that the plane 73 along which the ejection-tray placement surface 19 lies does not intersect with the properly deployed media tray 2 when the ejection tray body 14 is at the midway position. The projection 92 is formed such that a medium 93 placed on the ejection tray 91 is curved and a protruding portion 94 of the medium 93 protruding from the ejection tray 91 intersects with the plane 73.

With the ejection tray 91 having this structure, the protruding portion 94 of the medium 93 protruding from the ejection tray 91 contacts the properly deployed media tray 2 when the ejection tray body 14 is at the midway position. In other words, the ejection tray 91 is formed such that the protruding portion 94 of the medium 93 protruding from the ejection tray 91 contacts the properly deployed media tray 2 when the ejection tray body 14 is at the midway position.

Figure 16:
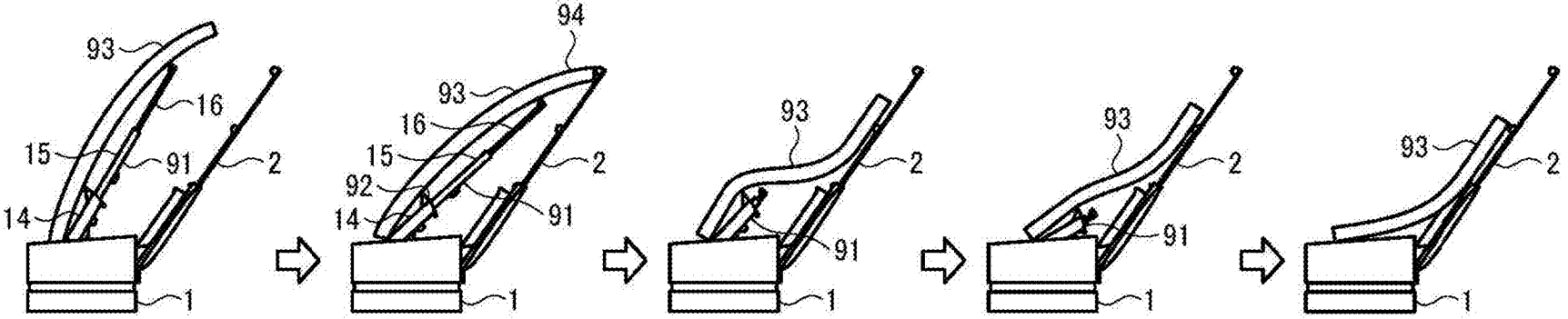
FIG. 16 is a transition diagram depicting an operation of the medium conveying apparatus according to the second embodiment and the behavior of a medium viewed from the side when the ejection tray is stored.

The medium conveying apparatus according to the second embodiment conveys one by one multiple media placed on the properly deployed media tray 2 along the conveying path 8 and places the media on the properly deployed ejection tray 91 similar to the image reading apparatus 10 described above. FIG. 16 is a transition diagram depicting the operation of the medium conveying apparatus according to the second embodiment and the behavior of the medium 93 viewed from the side when the ejection tray 91 is stored. Although only one medium is depicted in FIG. 16 for the purpose of simplifying the explanation, multiple media can be placed on the ejection tray 91. The ejection-tray deploying-storing mechanism 31 of the medium conveying apparatus according to the second embodiment stores the ejection tray 91 in the same manner as the ejection tray 3 described above after all the media inserted into the feed opening 6 are placed on the ejection tray 91. In other words, the ejection tray 91 is retracted after all the media inserted into the feed opening 6 are placed on the ejection tray 91. In parallel with the retraction of the ejection tray 91, the ejection tray body 14 swings toward the ejection-tray stored position and is at the midway position.

The portion 94 of the medium 93 protruding from the ejection tray 91 contacts the media tray 2 when the ejection tray body 14 is at the midway position. The gravity of the medium 93 acting on the ejection tray 91 is reduced when the protruding portion 94 is in contact with the media tray 2. The degree to which the ejection tray 91 is deflected by the medium 93 placed on the ejection tray 91 is reduced by reducing the gravity of the medium 93 acting on the ejection tray 91. The frictional force acting between the ejection tray body 14 and the first ejection-tray extension 15 and the frictional force acting between the first ejection-tray extension 15 and the second ejection-tray extension 16 decrease as the degree of deflection of the ejection tray 91 decreases. The frictional force acting between the medium 93 and the first ejection-tray extension 15 and the frictional force acting between the medium 93 and the second ejection-tray extension 16 decrease as the gravity of the medium 93 acting on the ejection tray 91 decreases.

The deploying-storing mechanism 34 includes the ejection-tray stopping mechanism 61 that stops the swinging of the ejection tray body 14 when the ejection tray body 14 is positioned at the midway position. The ejection tray 91 can be retracted when the swinging of the ejection tray body 14 is stopped. In other words, the medium conveying apparatus according to the second embodiment can stop the swinging of the ejection tray body 14 and retract the ejection tray 91 when the protruding portion 94 is in contact with the media tray 2 similar to the medium conveying apparatus according to the first embodiment described above. The medium conveying apparatus according to the second embodiment can reduce the frictional force resisting the retraction of the ejection tray 91 when the protruding portion 94 is in contact with the media tray 2. Thus, the ejection tray 91 can be retracted with a small force. A motor having a reduced capacity can be used as the motor 33 to generate the driving force to retract the ejection tray 3 because the ejection tray 91 can be retracted with a small force. Accordingly, the motor 33 can be compact, and the size of the apparatus can be reduced.

The ejection-tray stopping mechanism 61 resumes the swinging of the ejection tray body 14 toward the ejection-tray stored position after the ejection tray 91 is sufficiently retracted such that the first ejection-tray extension 15 is positioned at the first extension-tray extension midway position. The medium conveying apparatus according to the second embodiment can prevent the ejection tray 91 from contacting the media tray 2 by swinging the ejection tray body 14 from the midway position toward the ejection-tray stored position after the ejection tray 91 is sufficiently retracted. When the ejection tray 91 is properly retracted, the ejection tray body 14 can be positioned at the ejection-tray stored position, and thus the ejection tray 91 can be properly stored in the medium conveying apparatus body 1. The medium conveying apparatus according to the second embodiment can reduce power consumption by stopping the motor 33 after the ejection tray 3 is stored, similar to the image reading apparatus 10 described above.

Third Embodiment

Figure 17:
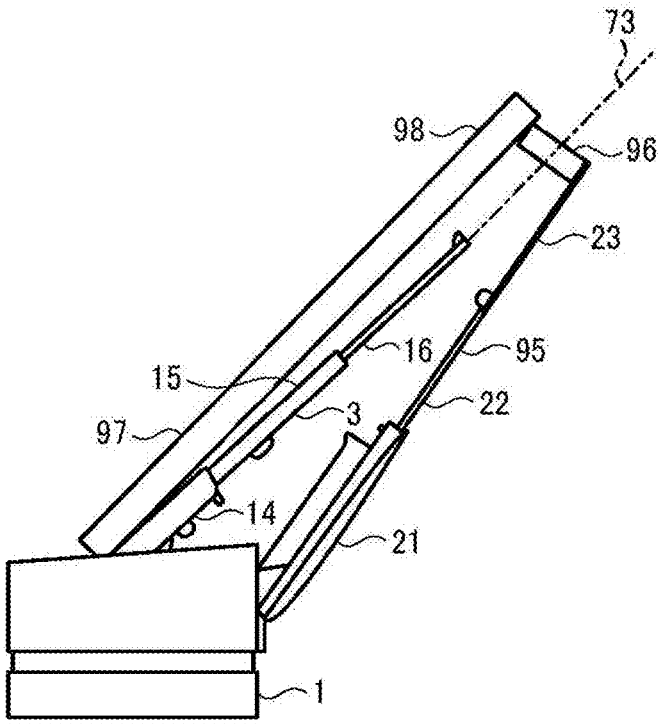
FIG. 17 is a side view of an image reading apparatus including a medium conveying apparatus according to a third embodiment.

A medium conveying apparatus according to a third embodiment is similar to the above-described medium conveying apparatus according to the first embodiment except that the above-described media tray 2 is replaced with a media tray 95 as illustrated in FIG. 17. FIG. 17 is a side view of an image reading apparatus including the medium conveying apparatus according to the third embodiment. The media tray 95 includes the media tray body 21, the first media-tray extension 22, and the second media-tray extension 23 like the media tray 2 described above. The media tray 95 further includes a projection 96. The projection 96 projects from the media-tray placement surface 26 and is fixed to the second media-tray extension 23. The media tray 95 is formed such that the plane 73 does not intersect with the media tray body 21, the first media-tray extension 22, and the second media-tray extension 23 when the ejection tray body 14 is at the midway position and the media tray 95 is properly deployed. The plane 73 intersects with the projection 96 when the ejection tray body 14 is at the midway position and the media tray 95 is properly deployed. With the media tray 95 having this structure, a protruding portion 98 of a medium 97 placed on the ejection tray 3 contacts the projection 96 when the ejection tray body 14 is at the midway position. In other words, the media tray 95 is formed such that the protruding portion 98 of the medium 97 placed on the ejection tray 3 contacts the projection 96 when the ejection tray body 14 is at the midway position and the media tray 95 is properly deployed.

Figure 18:
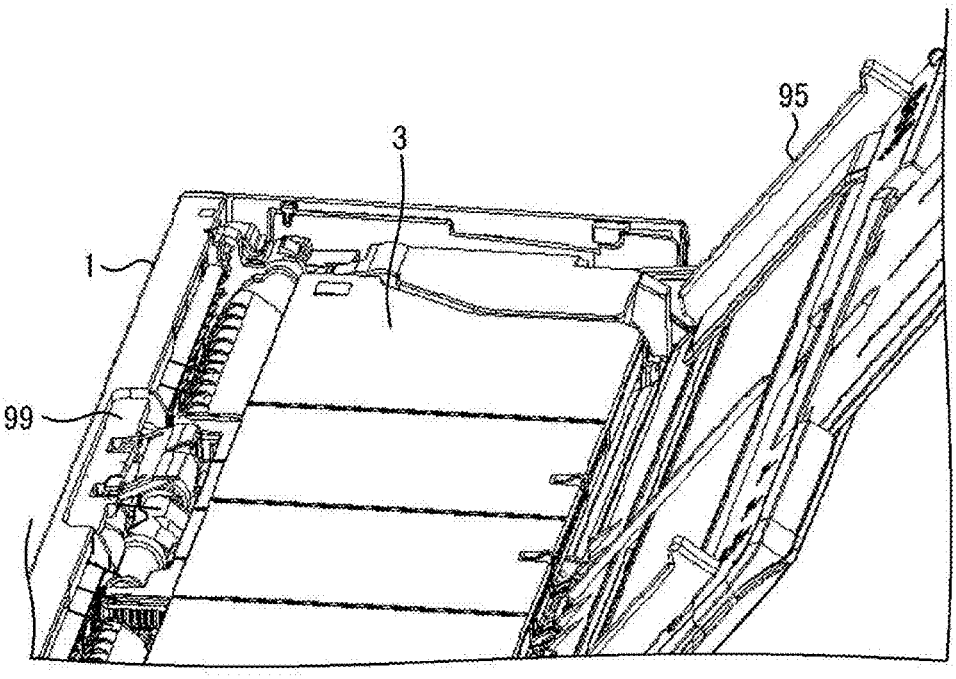
FIG. 18 is a perspective view of a medium conveying apparatus body of the medium conveying apparatus according to the third embodiment.
Figure 19:
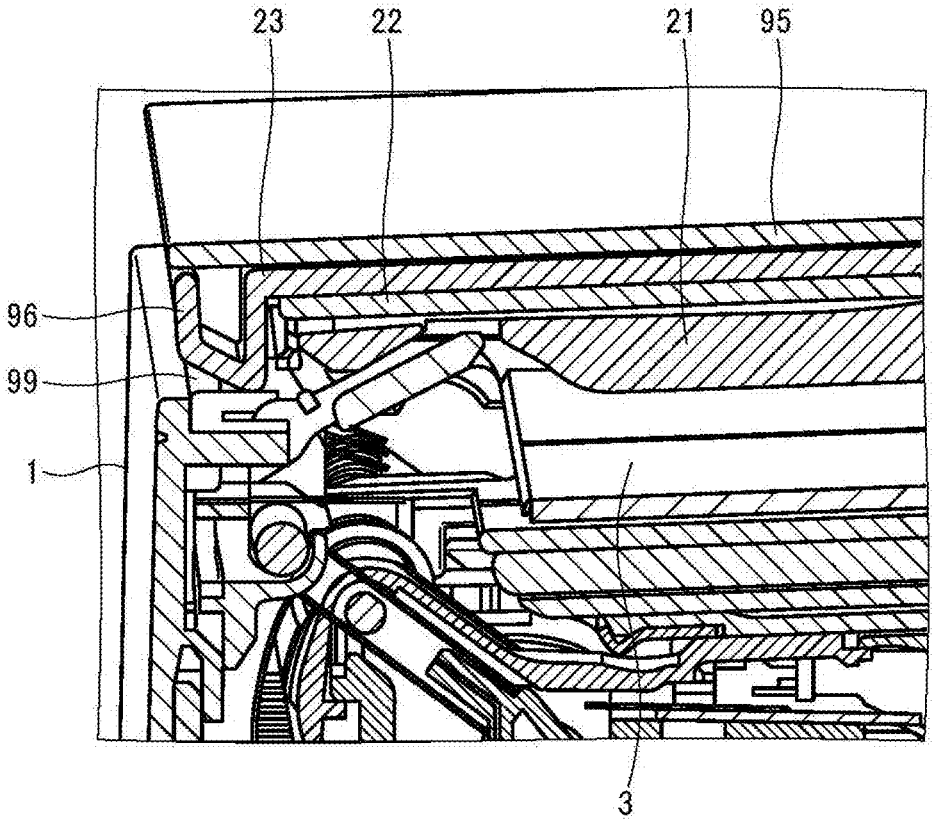
FIG. 19 is a perspective cross-sectional view of the medium conveying apparatus body according to the third embodiment in which the media tray is properly stored.

FIG. 18 is a perspective view of the medium conveying apparatus body 1 of the medium conveying apparatus according to the third embodiment. A recess 99 is formed on the upper face of the medium conveying apparatus body 1 of the medium conveying apparatus according to the third embodiment. FIG. 19 is a perspective cross-sectional view of the medium conveying apparatus body 1 and the media tray 95 of the medium conveying apparatus according to the third embodiment when the media tray 95 is properly stored. When the media tray 95 is properly stored, the projection 96 fits in the recess 99, i.e., a portion of the projection 96 is positioned inside the recess 99.

Figure 20:
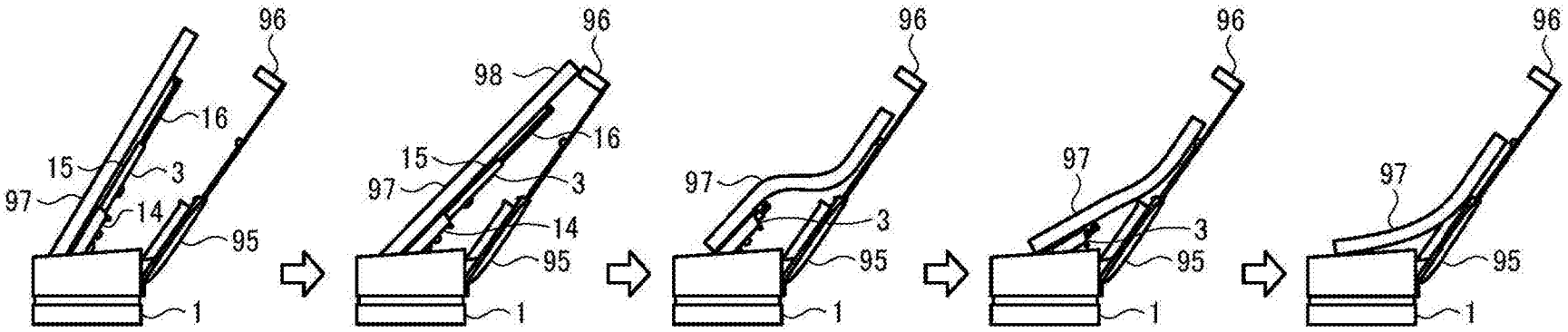
FIG. 20 is a transition diagram depicting an operation of the medium conveying apparatus according to the third embodiment and the behavior of a medium viewed from the side when the ejection tray is stored.

The medium conveying apparatus according to the third embodiment conveys one by one multiple media placed on the properly deployed media tray 95 along the conveying path 8 and places the media on the properly deployed ejection tray 3 similar to the image reading apparatus 10 described above. FIG. 20 is a transition diagram depicting the operation of the medium conveying apparatus according to the third embodiment and the behavior of the medium 97 viewed from the side when the ejection tray 3 is retracted. Although only one medium is depicted in FIG. 20 for the purpose of simplifying the explanation, multiple media can be inserted into the feed opening 6 and placed on the ejection tray 3. The ejection-tray deploying-storing mechanism 31 of the medium conveying apparatus according to the third embodiment stores the ejection tray 3 after all the media inserted into the feed opening 6 are placed on the ejection tray 3. That is, the ejection tray 3 is retracted after all the media inserted into the feed opening 6 are placed on the ejection tray 3. In parallel with the retraction of the ejection tray 3, the ejection tray body 14 swings toward the ejection-tray stored position and is positioned at the midway position.

The protruding portion 98 of the medium 97 protruding from the ejection tray 3 contacts the projection 96 of the media tray 95 when the ejection tray body 14 is at the midway position. The gravity of the medium 97 acting on the ejection tray 3 is reduced when the protruding portion 98 is in contact with the projection 96. The degree to which the ejection tray 3 is deflected by the medium 97 placed on the ejection tray 3 is reduced by reducing the gravity of the medium 97 acting on the ejection tray 3. The frictional force acting between the ejection tray body 14 and the first ejection-tray extension 15 and the frictional force acting between the first ejection-tray extension 15 and the second ejection-tray extension 16 decrease as the degree of deflection of the ejection tray 3 decreases. The frictional force acting between the medium 97 and the first ejection-tray extension 15 and the frictional force acting between the medium 97 and the second ejection-tray extension 16 decrease as the gravity of the medium 97 acting on the ejection tray 3 decreases.

The deploying-storing mechanism 34 includes the ejection-tray stopping mechanism 61 that stops the swinging of the ejection tray body 14 when the ejection tray body 14 is at the midway position. The ejection tray 3 is retracted when the swinging of the ejection tray body 14 is stopped. In other words, the medium conveying apparatus according to the third embodiment can stop the swinging of the ejection tray body 14 and retract the ejection tray 3 when the protruding portion 98 is in contact with the projection 96. The medium conveying apparatus according to the third embodiment can reduce the frictional force resisting the retraction of the ejection tray 3 when the protruding portion 98 is in contact with the projection 96. Thus, the ejection tray 3 can be retracted with a small force. Accordingly, the medium conveying apparatus according to the third embodiment can use a motor having a reduced capacity as the motor 33 to generate the driving force to retract the ejection tray 3 because the ejection tray 3 can be retracted with a small force. Accordingly, the motor 33 can be compact, and the size of the apparatus can be reduced.

The ejection-tray stopping mechanism 61 resumes the swinging of the ejection tray body 14 toward the ejection-tray stored position after the ejection tray 3 is sufficiently retracted such that the first ejection-tray extension 15 is positioned at the first extension-tray extension midway position. The medium conveying apparatus according to the third embodiment can prevent the ejection tray 3 from contacting the media tray 2 by swinging the ejection tray body 14 from the midway position toward the ejection-tray stored position after the ejection tray 3 is sufficiently retracted. When the ejection tray 3 is properly retracted, the ejection tray body 14 can be positioned at the ejection-tray stored position, and thus the ejection tray 3 is properly stored in the medium conveying apparatus body 1. The medium conveying apparatus according to the third embodiment can reduce power consumption by stopping the motor 33 after the ejection tray 3 is stored, similar to the image reading apparatus 10 described above.

The user stores the media tray 95 in the medium conveying apparatus body 1 after removing the media from the properly stored ejection tray 3 and the properly deployed media tray 2. The projection 96 fits in the recess 99 and is positioned in the recess 99 when the media tray 95 is properly stored in the medium conveying apparatus body 1. In the medium conveying apparatus according to the third embodiment, even when the media tray 95 is provided with the projection 96, the media tray 95 can be stored in the medium conveying apparatus body 1 by accommodating the projection 96 in the recess 99.

The medium conveying apparatuses according to the above-described embodiments are used in image reading apparatuses but may be used in other apparatuses. An example is a printer that prints characters and graphics on a medium. In the printer, the image reader 12 of the medium conveying apparatus in the above-described embodiment is replaced with a printing device that prints characters and graphics on the medium conveyed along the conveying path 8. In this case, the medium conveying apparatus can also retract the ejection tray with a small force similar to the medium conveying apparatuses according to the above-described embodiments.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A medium conveying apparatus comprising:

an apparatus body in which a conveying path is formed;

a media tray supported by the apparatus body;

an ejection tray supported by the apparatus body;

a conveyor to convey a medium placed on the media tray along the conveying path and place the medium on the ejection tray;

a first mechanism including a gear to swing the ejection tray from a deployed position where the ejection tray is deployed to a stored position where the ejection tray is stored in the apparatus body, wherein the first mechanism stops swinging of the ejection tray at a midway position between the deployed position and the stored position; and a second mechanism including a gear to retract the ejection tray when the swinging of the ejection tray is stopped.

2. The medium conveying apparatus according to claim 1, wherein the ejection tray includes:

an ejection tray body swingably supported by the apparatus body; and an extension movably supported by the ejection tray body, the conveyor places the medium on the ejection tray when the ejection tray body is positioned at the deployed position and the extension is positioned at an extended position, the ejection tray body is positioned at the stored position when the ejection tray is stored in the apparatus body, the ejection tray is formed such that a protruding portion of the medium protruding from the ejection tray contacts the media tray when the ejection tray body is positioned at the midway position between the deployed position and the stored position, the first mechanism stops swinging of the ejection tray body when the ejection tray body is positioned at the midway position, and the second mechanism retracts the extension toward a retracted position when the ejection tray body is positioned at the midway position.

3. The medium conveying apparatus according to claim 2, wherein the first mechanism includes:

a stopper swingably supported by the apparatus body;

a stopper releaser fixed to the extension; and a biasing spring to apply a force for swinging the stopper toward a retaining position, the stopper releaser contacts the stopper to swing the stopper toward a releasing position when the extension moves toward the retracted position, the ejection tray body contacts the stopper and is secured to the apparatus body to be prevented from swinging toward the stored position when the ejection tray body is positioned at the midway position and the stopper is positioned at the retaining position, and the ejection tray body is released from the stopper and swings toward the stored position when the stopper is positioned at the releasing position.

4. The medium conveying apparatus according to claim 2, wherein the ejection tray includes an ejection-tray placement surface to face the ejected medium, and a plane along which the ejection-tray placement surface lies intersects with the media tray when the ejection tray body is positioned at the midway position.

5. The medium conveying apparatus according to claim 2, wherein the ejection tray includes:

an ejection-tray placement surface to face the ejected medium; and a projection projecting from the ejection-tray placement surface, and the projection curves the ejected medium such that the protruding portion of the ejected medium intersects with a plane along which the ejection-tray placement surface lies.

6. The medium conveying apparatus according to claim 2, wherein the ejection tray includes an ejection-tray placement surface to face the ejected medium, the media tray includes:

a media tray body including a media-tray placement surface to face the medium; and a projection projecting from the media-tray placement surface, and a plane along which the ejection-tray placement surface lies intersects with the projection when the ejection tray body is at the midway position.

7. The medium conveying apparatus according to claim 6, wherein the media tray body is swingably supported by the apparatus body;

the conveyor conveys the medium along the conveying path when the media tray body is positioned at a media-tray deployed position, and the apparatus body includes a recess in which the projection fits when the media tray body is positioned at a media-tray stored position different from the media-tray deployed position.

* * * * *